United States Patent [19]

Gerlach et al.

[11] 4,342,801

[45] Aug. 3, 1982

[54] SUEDE-LIKE SHEET MATERIAL

[75] Inventors: Klaus Gerlach, Aschaffenburg; Nikolaus Mathes, Breuberg; Hans-Jurgen Pitowski, Miltenberg; Friedbert Wechs, Worth am Main, all of Fed. Rep. of Germany

[73] Assignee: Akzona Incorporated, Asheville, N.C.

[21] Appl. No.: 217,067

[22] Filed: Dec. 16, 1980

[30] Foreign Application Priority Data

Dec. 20, 1979 [DE] Fed. Rep. of Germany ..... 2951307

[51] Int. Cl.[3] ..... D02G 3/00

[52] U.S. Cl. ..... 428/91; 428/96; 428/290; 428/300; 428/301; 428/370; 428/374; 428/397; 428/315.9

[58] Field of Search ..... 428/91, 96, 290, 288, 428/300, 301, 310, 315, 317, 304, 305, 361, 362, 395, 397, 373, 374, 904, 370, 369; 264/171, 147

[56] References Cited

U.S. PATENT DOCUMENTS

| | | | |
|---|---|---|---|
| 3,562,374 | 2/1971 | Okamoto et al. | 264/174 |
| 3,811,923 | 5/1974 | Hammer et al. | 428/91 |
| 3,932,687 | 1/1976 | Okamoto et al. . | |
| 3,966,865 | 6/1976 | Nishida et al. | 264/147 |
| 4,024,307 | 5/1977 | Brahm et al. | 428/904 X |
| 4,073,988 | 2/1978 | Nishida et al. | 428/397 X |
| 4,145,468 | 3/1979 | Mizoguchi et al. . | |
| 4,165,556 | 8/1979 | Nishida et al. . | |
| 4,174,414 | 11/1979 | Sasaki et al. | 428/904 X |
| 4,233,359 | 11/1980 | Mimura et al. . | |
| 4,239,720 | 12/1980 | Gerlach et al. | 428/397 X |
| 4,276,044 | 6/1981 | Dieterich . | |

FOREIGN PATENT DOCUMENTS

| | | |
|---|---|---|
| 112794 | 6/1974 | German Democratic Rep. . |
| 1389804 | 4/1975 | United Kingdom . |
| 1487486 | 9/1977 | United Kingdom . |
| 2004496 | 4/1978 | United Kingdom . |

OTHER PUBLICATIONS

Okamoto, "Ultra-fine Fiber and its Application (part 2)", Chemiefasern/Textilindustrie, vol. 29/81, (Mar. 1979), pp. 175–178.

*Primary Examiner*—Lorraine T. Kendell

*Attorney, Agent, or Firm*—Francis W. Young; Jack H. Hall

[57] ABSTRACT

Staple fibers made from crimped, in particular compression crimped, multicomponent filaments of the matrix/segment type, the cross section of which shows, in addition to the matrix, at least 6 peripheral wedge-shaped or lenticular segments, not completely covered by the matrix, are processed into a web, which is then mechanically bonded, preferably by needling. Subsequently, the fabric is subjected to a shrinkage process, by which its density is increased by more than 30%, the multicomponent fibers being completely or partly split up into their components. The difference in shrinkage between the components should be at least 10%. The liquids used for the shrinkage treatment are in particular organic liquids, such as methylene chloride, as well as other liquids producing a difference in shrinkage of at least 20%. The fabric is then impregnated with a solution of polyurethane on the basis of polyglycols, specifically polytetramethylene glycol, diisocyanates and low-moleclar glycols as chain lengtheners, the jelling temperature of the solution being higher than the room temperature and higher than the temperature of the coagulation bath; the polyurethane is coagulated by cooling and/or treatment with a coagulation bath containing a non-solvent for polyurethane; then the fabric is washed, dried and ground on one or both sides. The suede-like product obtained combines great suppleness with high strength. It is an excellent material for making garments, such as coats, jackets or skirts, offering high wear comfort as well as high breathability.

16 Claims, 5 Drawing Figures

SUEDE-LIKE SHEET MATERIAL

BACKGROUND OF THE INVENTION

The subject matter of the invention is a suede-like product consisting of a textile sheet structure of multicomponent fibers which has been treated with a polyurethane solution.

A large number of products used as suede substitutes are known. The literature, as well, refers to numerous processes for the production of this type of material. For instance, U.S. Pat. No. 4,145,468 describes a textile composite suitable as support for synthetic leather comprising a woven or knit fabric and at least one nonwoven fabric combined therewith.

U.S. Pat. No. 3,932,687 describes a support material suitable for synthetic leather. The patent relates to a fiber web of special composite fibers, namely, so-called island-matrix composite fibers. A web of extremely fine fibers is obtained by dissolving the matrix component.

The production of these synthetic, suede-like materials is complex and cumbersome; and the properties are still unsatisfactory. Products having a woven or knitted fabric insert are relatively stiff. Using a web according to known processes leads to inadequate strength. Moreover, difficulties are experienced in the production and handling of very fine deniers. For instance, it is difficult to prevent bonding between the fibers of the textile support fabric and the polyurethane which is used for impregnation.

Consequently, there is still a need for an improved process for the manufacture of suede-like products, embodying especially a simplified process, and for synthetic suede-like material of improved characteristics.

OBJECT OF THE INVENTION

The object of the invention is to make available a suede-like product which can be obtained readily and economically and has good mechanical strength combined with great suppleness, a marked "finger marking" effect, will accept printing, offers interesting surface structuring possibilities, is versatile and can be used as a substitute for apparel leather in many diverse applications.

DESCRIPTION OF THE INVENTION

This objective is met with a suede-like product based on a textile sheet structure impregnated with polyurethane, characterized in that the textile sheet structure/-fabric is a needle-punched web of fully or partly split staple fibers of crimped, multicomponent filaments of the matrix:segment type composed of polyester and polyamide, whose cross section before splitting comprises in addition to the matrix a plurality of peripheral segments, preferably at least six, of wedge-shaped or lenticular cross section, which segments are not completely surrounded by the matrix, whereby the denier of the filament before splitting is about 0.5 to 10 dtex and the denier of the matrix and of individual segments is between 0.1 to 1 dtex; the segments having a shrinkage differential of at least 10% compared to the matrix; at least part of the multicomponent fibers being arranged bundle-like in the web; polyurethane comprising polyglycols and diisocyanate and low molecular weight glycols as chain extender; in that at least 30% of the surface of the fiber is not firmly bonded to the surrounding impregnating material, or conversely, less than 70% is firmly bonded. Matrix and peripheral segments may have a different denier.

The denier of the filaments before splitting is preferably 1 to 5 dtex and the denier of the matrix and that of individual segments preferably 0.1 to 0.5 dtex. The polyester component in terms of the surface component of the cross section of the fiber before splitting may amount to at least 10%. Quite suitable within the framework of the invention are staple fibers with polyamide segments exhibiting at least 20% higher shrinkage than the polyester matrix.

Multicomponent filaments having a polyamide matrix and peripheral polyester segments are also advantageous. It is beneficial to have the polyester segments exhibiting at least 20% shrinkage vis-a-vis the polyamide matrix. In an especially favorable embodiment of the invention, the multicomponent filaments have a polyester component of 70 to 90% based on the cross section of the fiber before splitting. In addition to homopolymers, the polyester components may consist of a copolyester, whereby copolyester of terephthalic acid and ethylene glycol and butylene glycol is particularly advantageous.

The polyamide component may be homopolymers and may also comprise copolyamides, such as caprolactam and adipic acid hexamethylene diamine salt.

A very efficient impregnation material contains polyurethane obtained from polytetramethylene glycol, ethylene glycol and 4,4'-diphenyl methane diisocyanate.

The suede-like product according to the invention has generally a total density of at least 0.25 g/cc, preferably 0.3 g/cc. It is beneficial to have in the product a density gradient to the effect that the density decreases from the middle to the outer faces, i.e., towards the top and bottom. In the end product, the impregnation substance exhibits a microporous structure and forms at least in part a tubular or tunnel-like sheath about the individual matrix and fibers, formed after splitting of the multicomponent filaments, whereby the lumen of the sheath surrounding the individual fibers is larger than the volume of the encompassed fiber section. The volume enclosed by the lumen is preferably twice the volume of the fiber. Within the tubular sheath, the fibers are expediently and largely without firm connection with the surrounding impregnation material, but no more than 70% of the surface of the encompassed fiber is firmly bonded to the lumen surface.

For the production of suede-like products according to the invention, use can be made of a process to manufacture a textile sheet structure of multicomponent fibers and impregnating the latter with a polyurethane solution, characterized in that a web is produced from staple fiber of crimped multicomponent filaments of the matrix/segment type. The cross section of the filaments comprises, in addition to the matrix, at least six wedge-shaped or lenticular, peripheral segments not completely enclosed by the matrix. The web is mechanically bonded, e.g., by needle-punching. Its density may be increased by 30% or more through shrinkage, which will also completely or partly split the multicomponent fibers into their components. The shrinkage differential between the two components should be at least 10%. The web is then impregnated with a polyurethane solution based on polyglycols and diisocyanates with low molecular weight glycols as chain extenders. The gel formation temperature of the polyurethane solution is higher than ambient temperature and higher than the temperature of the coagulation bath that may be used, so that the polyurethane is set by cooling with air and/or treatment in a coagulation bath containing a non-solvent of the polyurethane. Finally, after washing and drying the impregnated web, one or both faces of the web are buffed to give the fabric a velour-like surface.

Preferably, use is made of multi-component filaments whose components have a room temperature shrinkage differential in the particular shrinkage liquid, of at least 10%, preferably at least 20%. In a special embodiment of the process, use is made of multicomponent fibers having after treatment with water a shrinkage differential of at least 20%. The preferred multi-component filaments comprise a polyamide matrix component and polyester peripheral segments in which the polyester component comprises from about 70% to about 90% of the cross sectional area of the multicomponent filaments.

Shrinkage of the fibers in the web is preferably developed by treatment with methylene chloride. Said methylene chloride may contain 0.5–5 wt. % of a methylene chloride-soluble finish, one suitable product which is available at the time of application being sold under the tradename Soromin AF. Furthermore, the shrinkage may also be developed with dimethylformamide at a temperature above 120° C.

Particularly suitable for impregnating the webs is a solution of polyurethane obtained from reactions of polytetramethylene glycol with ethylene glycol and diphenyl methane diisocyanate. For best results, the polyurethane may contain a light stabilizer, specifically a product available at the time of application under the tradename of Irganox 1010. In a special embodiment described hereinafter, the web may be impregnated asymmetrically.

The process disclosed in copending U.S. patent application Ser. No. 180,786, filed Aug. 25, 1980, is eminently suitable for the production of the multicomponent filaments used according to the invention, and is hereby incorporated by reference herein in its entirety. FIGS. 2–6 of the said application are identical with FIGS. 1–5 of the instant application, and reference may be had to said application for a complete description.

For purposes of the present application, the following brief descriptions of the drawings will suffice:

Figure 5:
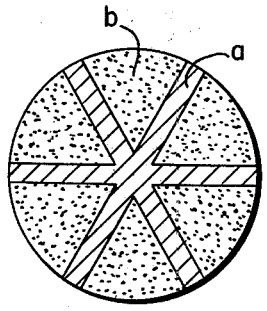
FIG. 5 represents a cross-section of a multicomponent filament having six wedge-shaped segments separated by a matrix suitable for making the suede-like product of the invention.

Filaments having a cross-section with the wedge-shaped segments of FIG. 5 of this application are especially well-suited for the production of the suede-like product. The multicomponent fibers, especially those having a wedge-shaped cross-section, can be subjected after spinning to various treatments such as drawing, crimping, application of special finishes and cutting without substantial separation between matrix and segments. Splitting into individual components is only achieved as a result of shrinkage development by treatment with a special medium.

Figure 1:
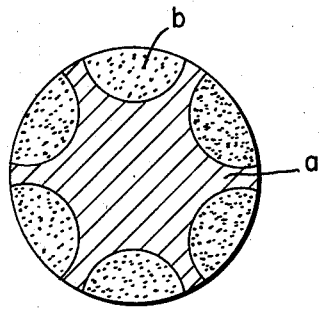
FIG. 1 represents a cross-section of a multicomponent filament having six lenticular segments separated from each other by a matrix suitable for making the suede-like product of the invention.
Figure 2:
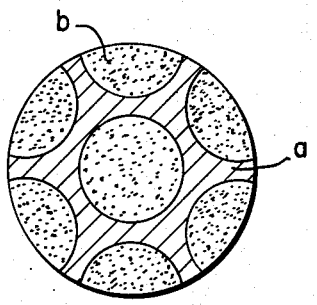
FIGS. 2–4 represents cross-sections of other multicomponent figures having lenticular segments suitable for making the suede-like product of the invention.
Figure 3:
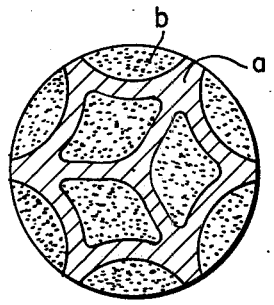
Figure 4:
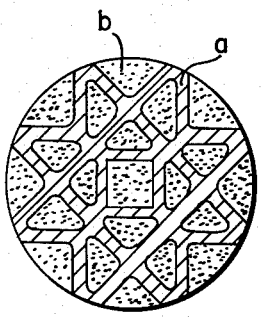

The term lenticular cross section of the segments refers to cross section shapes shown in FIGS. 1 to 3 of this application.

The multicomponent filaments obtained according to the teachings of the patent application are crimped in a conventional manner before splitting. The stuffer-box crimping process is eminently suitable.

In stuffer box crimping, care should be taken to avoid sharp edges in the crimp waves, since this may lead to occasional incipient splitting of the multicomponent filaments at bending points. Such partly split multicomponent filaments may cause problems during web formation. With standard settings, however, the multicomponent filaments will undergo stuffer box crimping without splitting. It is important that preliminary treatments of the fibers be performed in the absence of any setting that would reduce the inherent shrinkability of the multicomponent filaments and it is, therefore, not desirable to steam the filaments or to dry them at elevated temperatures. The shrinkability, i.e., the shrinkage differential between polyester and polyamide components is best determined by treatment with methylene chloride, as described on page 7, lines 16–21 of copending U.S. patent application Ser. No. 16,560, filed Mar. 1, 1979, which is incorporated herein by reference in its entirety. The shrinkage produced by methylene chloride should be at least 10%, preferably 15%, and may exceed 20%.

Conventional polyesters and polyamides may be used as the components in the production of the multicomponent filaments. Polyethylene terephthalate is eminently suited as the polyester component. However, copolyesters based, e.g., on an acid such as terephthalic acid and two different glycols, such as ethylene glycol and butylene glycol, may be used. Components of copolyesters generally have a better dye affinity and a higher shrinkage.

The polyamides may be conventional polyamides, such as poly-ε-caprolactam and the polyamide based on hexamethylene diamine and adipic acid. Copolyamides may also be used, and in particular copolyamides of ε-caprolactam and hexamethylene diamine adipic acid salt are suitable.

The multicomponent filaments may be structured to have peripheral segments of polyamide and a polyester matrix. Preferably, however, a cross section is produced whereby the polyamide forms the matrix and polyester the segments.

Conventional adducts, such as pigments, carbon black, flame-retardants, delusterants and the like may be added to individual components.

After stuffer box crimping, the filaments are cut with a conventional cutter to staple fiber of a length conventional for cotton-type fibers, namely, staple lengths ranging between about 30 and 50 mm, preferably about 40 mm.

The resulting staple fiber is used for the manufacture of a web by conventional techniques, such as, for example, air laying, or by means of a card. The weight of the web may range between 50 to 500 g/m$^2$, preferably between about 100 and 400 g/m$^2$.

The web is subsequently conventionally needle-punched to increase the mechanical bonding of the web. it also improves the mechanical strength of the web. Aside from needle-punching, the web can be bonded by treatment with air or water jets. Mechanical bonding by needle-punching is, however, preferable. By judicious selection of the needle-punching conditions, the characteristics of the webs may be adjusted to subsequent end uses.

Generally, needle-punching is performed at a high stitch number, e.g., stitch counts of 500 to 1500/cm$^2$ are eminently suitable. Needle-punching greatly increases the density of the web and leads to considerable realignment of the fiber in a direction perpendicular to the web plane. This plays, among other things, an important part as regards the pile of the end product.

The resulting web is then subjected to a treatment whereby the density is increased by high total shrinkage by more than 30% and whereby the multicomponent fibers are fully or partly split into individual components. A treatment medium, in particular an organic liquid, in which individual components exhibit a shrinkage differential of at least 10% is required for this. In particular, those organic solvents which lower by at least about 160° C. the zero shrinkage temperature of the used polyester, as described in patent application Ser. No. 16,560, are suitable. They include the organic solvents: methylene chloride; 1,1,2,3-tetrachloroethane; 1,1,2-trichloroethane and chloroform, enumerated in the above patent application, preferably methylene chloride.

Shrinkage development whereby satisfactory splitting of the fibers is achieved can also be accomplished with dimethyl formamide, which is at a temperature of at least 120° C.

If copolyamides are used as components, splitting with water is also possible. The production of corresponding multicomponent fibers in conjunction with copolyamides as one component and splitting of the multicomponent fibers with water is described in U.S. patent application Ser. No. 124,256, filed Feb. 25, 1980, which is incorporated herein by specific reference.

In some cases, it is advisable to reinforce the splitting procedure by additional mechanical treatment during shrinkage. It is especially beneficial to subject the web to ultrasound treatment in the presence of the shrinkage medium. Such a process is described in U.S. patent application Ser. No. 16,534, filed Mar. 1, 1979, now abandoned, which is incorporated herein by specific reference.

For treatment with the liquid to develop the shrinkage and, among other things, produce splitting, it is sufficient, e.g., when using methylene chloride, to have the web travel briefly through a bath containing the treatment agent. However, the web may also be sprayed or the solvent my be applied in any other fashion. After treatment with the liquid, during which the fiber is fully or partly split into individual components, as much of the solvent as possible is removed from the web, e.g., by squeezing off.

The temperature of the treatment liquid is generally 20° to 40° C. Depending on the density and thickness of the needle-punched web, the treatment time may extend from a few seconds to a few minutes. The solvent can be squeezed off by means of the squeezing pressure or the clearance of the squeezing rollers. In certain cases, the solvent can be removed without pressure by suction.

During treatment with the liquid, it is important to have as little tension as possible on the web running through the bath, or to spray it with the solvent in the absence of tension to insure maximum shrinkage. As a result, the longitudinal and transverse shrinkage of the web will generally be identical. This treatment results in an area shrinkage generally above 30%, preferably even 35 to 55%. However, the thickness of the web remains nearly constant, therefore, there is a sharp increase in density during shrinkage treatment. Densities exceeding 0.15 g/cc, preferably exceeding 0.25 g/cc can be obtained.

This special shrinkage process yields the following special effects. Compared with a product without or not as high a shrinkage, pile density can be increased by more than 50%, and in some cases, more than 100%. Pile density refers to the number of protruding fibers/hairs per mm$^2$ in the end product. Pile densities of 450/mm$^2$ and more are feasible.

Furthermore, the mid-section of the web has a higher density than the outer surfaces, i.e., than the top or bottom side, therefore, a corresponding density gradient is present in the end product. Thus, the density of the end product decreases from the center outwards, resulting in a firm but still supple hand.

The material is at first readily compressible, but then offers increasing resistance. Based on the high recovery, it readily resumes its initial appearance; it is thus essentially very much like natural kid-skin suede.

The total density of the end product is at least 0.25 g/cc, preferably more than 0.3 g/cc.

Additives which will reduce the adhesion between the polyurethane to be applied in the next process phase and the fiber can be added to the shrinkage treatment bath. An end product of greater softness, suppleness, and a more textile-like drape for the suede can be obtained thereby. Film-forming, methylene chloride-soluble finishes, such as fatty acid condensation products, e.g., the BASF product available under the tradename Soromin AF, are added to the methylene chloride treatment bath. As a rule, addition of as little as 0.5 to 5% of the finish to the methylene chloride bath will be adequate.

The web is dried following treatment with the shrinkage medium. Air at a temperature ranging between 50° to 80° C. is preferably used for this. However, the temperature may be raised up to 180° C. In some cases, it is advisable to subject the structure of the split fiber web to a subsequent loosening procedure consisting of a shearing treatment by means of cylinders; the fiber cohesion can also be loosened by a light additional needle-punching treatment, while a fulling treatment may also loosen the structure.

The resulting web composed of fully or partly split multicomponent fibers is impregnated by submerging the web in a solution of polyurethane. The polyurethanes which may be used are those obtained from polyglycol diisocyanates and low molecular weight glycols as chain extender. These polyurethanes are expediently prepared according to the teachings of German Offenlegungschrift No. 2,409,346, using as polyglycol, preferably polytetramethylene glycol, and as low molecular weight glycol, preferably ethylene glycol. An especially suitable diisocyanate is 4,4'-diphenyl methane diisocyanate.

In addition to polyurethanes containing diphenyl methane diisocyanate as diisocyanate, polyurethanes containing as diisocyanate component dicyclohexyl methane diisocyanate are also suitable. The polyurethane used for impregnating may also contain conventional additives, e.g., pigments; silicone oil; fillers, such as calcium carbonate; blowing agents, such as sodium sulfate; stearyl alcohol; light stabilizers, e.g., the Ciba Geigy product available under the tradename "Irganox 1010" and other stabilizers.

Various impregnation methods may be used, in particular a method whereby the web runs through a tank containing the polyurethane solution essentially in the absence of tension. The temperature of the polyurethane solution used for dipping is above room temperature and above the gel-formation temperature of the polyurethane solution, being preferably between 40°–70° C. This will reduce the viscosity to about 5 poise allowing for proper and rapid impregnation of the web.

The gel formation temperature or gel point is the temperature at which the polymer solution separates in two phases, e.g., the so-called settling point at which polymer droplets just begin to form. The gel point is a function of the concentration of polyurethane and the proportion of nonsolvent, e.g., water, in the solution. The gel point can be determined by adding water to a polymer solution which is homogeneous and constant at room temperature until phase separation is achieved. Phase separation can be further enhanced by further addition of water or by reducing the temperature.

Heating of a polyurethane solution separated in two phases causes the two-phase system to revert to a homogeneous polymer solution. For dipping, use is made of polyurethane solutions which form gels when cooled to room temperature.

The web travels, expediently, from top to bottom through the tank containing the polyurethane to be applied, thence over suitable deflection systems it is led out of the tank. After emerging from the tank, the web advances to a set of two squeeze rollers whose nip point is adjusted to leave 100 to 500% of the polyurethane solution in the web.

In addition to the above-described dipping process, the material can be impregnated by other methods, e.g., coating, spraying, etc., with impregnating agent. A suitable process consists of applying the coating or impregnating by means of a reverse roll coater.

The web may also be impregnated asymmetrically, i.e., whereby the web has different concentrations of impregnating material, thus providing an impregnation agent gradient. This can be achieved by, e.g., running the impregnated web on a sharp edge or a small diameter bar. In so doing, the side in contact with the sharp edge or bar is squeezed off, so that as it resumes travel on a straight path, there is less polyurethane present at the zones where squeezing took place. This side of the web will also contain less polyurethane after coagulation than the opposite side. The unwinding behavior, crease formation, and different other properties of the suede can be controlled in this manner. The coating with less polyurethane represents the pile side of the end product. Products of this type are characterized by asymmetrical structure.

After squeezing off excess polyurethane solution, the web travels also through an air zone at room temperature within which the viscosity of the solution increases sharply and a certain degree of coagulation sets in. The web then travels to one or more coagulation baths containing a polyurethane non-solvent, preferably containing water and, additionally, under certain conditions, a minor amount of a polyurethane solvent.

The coagulation initiated by cooling with air is completed in the coagulation bath, also referred to as a precipitation bath. It is expedient to use several consecutive baths. It is essential that the temperature of the first bath be lower than the gel point, i.e., lower than the gel formation temperature of the dipping solution used. The first precipitation bath may, therefore, contain water brought, e.g., to a temperature of 30° C. or it may contain 80% water and 20% of a polyurethane solvent, e.g., dimethyl formamide. Among other things, the latter bath composition leads to a microporous polyurethane, and, furthermore, the adhesion between polyurethane and fibers is minimized due to the formation of tubular or tunnel-shaped cavities, with ample space to accommodate the fibers.

The second precipitation bath may be at a lower temperature, room temperature being satisfactory. Coagulation can usually be completed by passing the dipped web through two precipitation baths before washing. Water heated to a temperature of, e.g., about 40° to 50° C. is used for washing. Using several wash baths can be beneficial.

The impregnated web is dried after washing. The drying temperature should preferably not exceed 100° C. The dry web is then buffed on one or both sides. Under certain conditions, before buffing, the product may be split one or more times, which would result in a thinner fabric.

For buffing of one or both sides, use can be made of conventional buffing/grinding rolls or other equipment which use carborundum or other materials for grinding. Buffing serves on the one hand to adjust the final thickness of the suede-like product, and on the other hand buffing produces optimum pile formation.

Before or after buffing, the surface can be structured or given certain optics by embossing with calendar rolls.

The product of the invention can be dyed and finished by conventional methods. Because of the hydrolysis resistance of the polyurethane, dyeing can be performed under high temperature conditions, which simultaneously insures a better hand. The high melting point of polyurethane also allows transfer printing without leading to any alteration of the product.

Before or after dyeing, the sheet structure can be readily split once or repeatedly with conventional leather industry equipment. In this manner, the manufacturing process can be very economical while materials of different weights/thicknesses and surface structures are feasible.

Conventional final finishing treatments, such as brushing, raising, buffing, lubricating, tumbling, fulling and hydrophobic treatments can be applied by conventionally known methods.

The suede-like product of the invention exhibits a series of surprising characteristics. It offers, for instance, interesting dyeing features, different dye effects can be obtained by applying a dyeing treatment whereby the fibers resist dyeing and only the polyurethane component is dyed. It is also possible, e.g., to use pigmented polyurethane and to leave the fiber undyed. With disperse dyes, the polyester can be dyed while the polyamide component does not dye. Pleasing effects can be achieved in this manner. The surface presents a very lively appearance and has a distinct "finger marking" effect. "Finger marking" effect refers to the effect obtained, e.g., when running a finger over the fabric, causing the position of the pile to be changed permanently, so that a distinct track is left behind. This marking effect imparts a lively appearance to the suede.

Moreover, the suede product of the invention is very supple and strong.

Drapability of the suede is excellent; it can be used in many applications, e.g., for wearing apparel, e.g., coats, jackets, skirts, headgear, etc. It possesses great wear comfort and breathability.

Because of high mechanical strength and low abrasion, it yields apparel that can be worn for long periods of time without becoming unsightly.

The production method is simple, economical and non-polluting. Preliminary treatment of the fiber with polyvinyl alcohol or water-soluble coatings before polyurethane treatment and washing after impregnation with water are no longer required. Splitting the multicomponent fibers into matrix and segments which is combined with a simultaneous, beneficial shrinkage and densification process is simple, reliable and effective; moreover, there is no loss of material due to splitting; processing presents no difficulties. It is, furthermore, emphasized that the process makes possible rapid and uniform impregnation.

The invention is explained in detail on hand of the following example:

A matrix/segment filament with segments of polyethylene terephthalate and with a matrix of polyamide 6 having the cross section shown in FIG. 5, of 1.7 dtex filament denier is spun according to said U.S. patent application Ser. No. 16,560 by means of a 150-orifice spinneret in which polyethylene terephthalate (rel. visc. 1.63) and polyamide 6 (re. visc. 2.5) in a weight ratio of 80:20, respectively, form the segments and the matrix.

The spinning draw-off rate is 1500 mpm, and the draw ratio is 1:3.3. Shrinkage of the filament in methylene chloride is about 24%. The resulting filament bundles are combined to a 51,000 dtex tow, run through a finish bath and finally crimped in a turbo crimper. The tow exhibits a crimp of 110 crimp waves per 100 mm and a crimp contraction of 10.3%. After drying at 50° C., the tow is cut to staple lengths of 40 mm.

This cardable, unsplit multicomponent fiber is made into a web by means of a carding technique (180 $g/m^2 2\times 12$ layers of 7.7 $g/m^2$). Needle punching with No. 43 gauge needles produces, after about 16 passages, a stitch count of 1000 stitches/$cm^2$ and a weight of about 120 $g/m^2$ and a web density of about 0.17 g/cc.

The web is subjected to high shrinkage to achieve fibrillation of the matrix/segment filaments and to increase its density, passing the web loosely and without tension through a methylene chloride bath at about 25°–30° C., with a retention time of about 30 sec. Methylene chloride is removed by squeezing off between a set of two squeeze rolls, although some 100 to 150% based on the web weight remains in the web. This amount is removed by drying at 80° C. and recovered.

Fibrillation and laminar shrinkage result in a distinctly denser web (about 0.27 g/cc) having a compact hand and a high stitch count.

The levelling effect, felting and softness of the web after treatment are very impressive. There is no significant change in thickness. Shrinkage: longitudinal, about 19%; transverse, about 24%; area, about 40%. Both felting and the great number of fibrils per unit volume produce an increase in strength.

Subsequently, the web is passed through a 10% pigmented polyurethane solution in dimethyl formamide with 4% water added. The gel point of this solution is about 35° C. To insure good penetration of the Polyurethane solution, the dipping solution temperature is brought to about 55° C. This reduces the viscosity of the solution to about 5 poise. The level of polyurethane solution on the web is adjusted to about 300% by passing the web through the nip point of a pair of rollers. On emerging from the dip tank, the polyurethane material is cooled by air and drops below the gel point, which results in immediate stabilization of the sheet structure because of the related increase in viscosity of the gel to above 50 poise. The polyurethane coating has a microporous coagulated structure with a low adhesion for the surface of the fiber. Coagulation is completed in a bath containing a dimethyl formamide: water system (20:80) at about 30° C. This is followed by washing in cold water, then in 40° C. water until all dimethyl formamide is removed with subsequent drying at 100° C.

These griege goods obtain a velour-like texture as a result of buffing both sides by means of a buffer roll unit, using No. 120 grit paper. The pile is raised to obtain a velour-like surface. The fine fibrils, large needle count and the significant densification during splitting produce in combination a dense pile exhibiting a lively "finger marking" characteristic.

The resulting product has a density of about 0.4 g/cc and a polyurethane content of about 22%.

The fibers of the material are jet-dyed under high temperature conditions, whereby the supple hand is developed.

By buffing or grinding with 180-grit paper, the pile is raised, yielding a product with good optics and hand having good wear properties.

We claim:

1. A suede-like textile sheet structure impregnated with a microporous polyurethane, said textile sheet structure comprising a needle-punched web of fully or partly split staple fiber from crimped multicomponent filaments of the matrix/segment type with polyester and polyamide as components, the cross section of the filaments before splitting comprises a matrix and at least 6 peripheral segments not completely embedded in said matrix, which segments have a wedge-shaped or lenticular-shaped cross section, each filament having a denier before splitting of about 0.5 to 10 dtex, said matrix of individual segments having a denier from about 0.1 to about 1 dtex; said segments having a shrinkage differential of at least 10% compared to the matrix, said polyurethane is composed of polyglycols, diisocyanate and low MW glycols as chain extender, and at least in part surrounds the individual fibers after the fashion of tubes, whereby the lumen of the tubular section surrounding the fibers is larger than the volume of the embedded fiber section and less than 70% of the surface of said individual segment and matrix fibers is firmly bonded to said polyurethane impregnating substance.

2. The suede-like sheet structure of claim 1, wherein said unsplit filaments have a denier of about 1 to 5 dtex and a matrix and segment denier of about 0.1 to 0.5 dtex.

3. The suede-like sheet structure of claim 1, wherein the surface component of the cross section of the polyester component of the fiber before splitting is 10%.

4. The suede-like sheet structure of claim 3, wherein said staple fiber comprises polyamide segments which have at least 20% more shrinkage than said polyester matrix.

5. The suede-like sheet structure of claim 1, wherein said multicomponent filaments comprise a polyamide matrix and peripheral polyester segments.

6. The suede-like sheet structure of claim 5, wherein said polyester segments have at least 20% more shrinkage than said polyamide matrix.

7. The suede-like sheet structure of claims 4 or 5, wherein the cross section of said polyester component of the fiber before splitting is from 70% to 90%.

8. The suede-like sheet structure of claim 5, wherein said polyester components are copolyesters.

9. The suede-like sheet structure of claim 8, wherein said copolyesters are based on terephthalic acid, ethylene glycol and butylene glycol.

10. The suede-like sheet structure of claim 5, wherein said polyamide matrix is a copolyamide based on ε-caprolactam and adipic acid/hexamethylene diamine salt.

11. The suede-like sheet structure of claims 1, 4 or 5, wherein said polyurethane is based on polytetramethylene glycol, ethylene glycol and 4,4'-diphenylmethane diisocyanate.

12. The suede-like sheet structure of claims 1 or 11, having a total density of at least 0.25 g/cc.

13. The suede-like sheet structure of claim 12, having a density gradient, the density decreasing from the center of the impregnated web to each of the surfaces of the web.

14. The suede-like sheet structure of claim 1, wherein said lumen of the tubular section is at least twice as large as the volume of the embedded fiber section.

15. The suede-like sheet structure of claim 14, wherein the embedded fiber is substantially without firm connection with the surrounding impregnating substance.

16. The suede-like sheet structure of claim 1, wherein said multicomponent fibers are at least partly aligned as bundles in the web.

* * * * *